US005408845A

United States Patent [19]

Forshaw et al.

[11] Patent Number: 5,408,845

[45] Date of Patent: Apr. 25, 1995

[54] COOLING OR CHILLING APPARATUS

[76] Inventors: Brian Forshaw; Joseph Clarke, both of 38 Brindisi Avenue, Ilse of Capri, Gold Coast, Qld 4217, Australia

[21] Appl. No.: 132,282

[22] Filed: Oct. 6, 1993

[30] Foreign Application Priority Data

Sep. 8, 1993 [AU] Australia ..... PM1096

[51] Int. Cl.[6] ..... F25D 17/02

[52] U.S. Cl. ..... 62/376; 62/438; 62/373

[58] Field of Search ..... 62/457.1, 457.2, 457.4, 62/457.5, 457.9, 430, 433, 376, 435, 438, 373

[56] References Cited

U.S. PATENT DOCUMENTS

| | | | |
|---|---|---|---|
| 142,806 | 9/1873 | Moos | 62/433 |
| 2,061,427 | 11/1936 | King | 62/438 |
| 2,422,350 | 6/1947 | Gross | 62/457.1 |
| 3,888,092 | 6/1975 | Fisher | 62/376 |
| 4,715,195 | 12/1987 | Kucza | 62/376 |
| 4,916,922 | 4/1990 | Mullens | 62/384 |
| 5,237,835 | 8/1993 | Brochier | 62/376 |
| 5,243,833 | 9/1993 | Coelho et al. | 62/376 |
| 5,284,028 | 2/1994 | Stuhmer | 62/451.3 |

FOREIGN PATENT DOCUMENTS

| | | | |
|---|---|---|---|
| 491671 | 6/1992 | France | 62/457.5 |

*Primary Examiner*—Henry A. Bennett
*Assistant Examiner*—William C. Doerrler
*Attorney, Agent, or Firm*—Hoffman, Wasson & Gitler

[57] ABSTRACT

Cooling or chilling apparatus for cooling or chilling beverage containers such as bottles or cans including a chamber which includes a chilling liquid cooled by a refrigeration unit and a support arrangement for supporting containers in the liquid. A flexible membrane in the form of a plastics bag surrounds the containers to prevent the containers coming into direct contact with the liquid but which permits the chilling liquid to cool the contents of the containers.

18 Claims, 4 Drawing Sheets

COOLING OR CHILLING APPARATUS

TECHNICAL FIELD

THIS INVENTION relates to cooling or chilling apparatus which in a particular but not exclusive aspect, may be applied to the chilling of beverages in containers such as beer, wine and soft drinks in bottles or cans.

BACKGROUND ART

Beverages in containers are normally cooled in conventional refrigerators, or in larger commercial establishments, cold rooms. There is however usually a considerable period of time which elapses between the time at which the beverage container is placed into a refrigerator or cold room and the time at which its temperature is acceptable for drinking. More rapid cooling can be achieved by using ice, however, ice is not readily available in many situations and additionally cannot be contained easily without melting. The above problems are accentuated in establishments which are involved in the supply of cold beverages such as restaurants. In these situations, it is often impossible for a large range of wines or other beverages to be stored and maintained at a low temperature for service and supply. Some arrangements have been proposed whereby bottles or other containers are placed into a container carrying a chilled liquid, however, in these arrangements the bottles or other containers become wet and therefore are not immediately suitable for use. Additionally, there is a danger that wet bottles or containers can slip from the grasp of a user.

SUMMARY OF THE INVENTION

The present invention aims to provide apparatus for cooling or chilling beverages and in particular beverage containers such as wine bottles, beer and soft drink bottles, cans or the like, and the contents thereof, in a rapid and efficient manner whilst maintaining the beverage containers substantially dry. Other objects and advantages of the invention will become apparent from the following description.

With the above and other objects in view the present invention provides apparatus for cooling or chilling beverage containers and the contents thereof, said apparatus comprising a chamber, a cooling or chilling liquid within said chamber, means for supporting said beverage containers within said chamber, and flexible membrane means adapted to be disposed about containers supported by said supporting means whereby said containers are subject to the cooling or chilling effect of said liquid but prevented from direct contact with said cooling or chilling liquid.

Preferably the supporting means includes a framework for supporting the containers so that a major portion thereof is below the level of the cooling or chilling liquid in the chamber. The flexible membrane means is associated with or arranged adjacent the framework which fluidly isolates the containers from the liquid but which may be urged against at least a portion of the container by the chilling liquid so that the cooling or chilling effect of the liquid is transferred through heat exchange to the container and the contents thereof. The flexible membrane means preferably comprises a bag formed of liquid impervious material, for example a plastics bag which may be located internally or externally of the framework. The bag suitably has its upper end or mouth supported above the level of liquid in the chamber.

The chamber preferably has a top cover provided with one or more openings into which respective containers to be chilled may be inserted. Associated with the or each opening is a respective framework for supporting respective containers to be chilled. The top cover preferably includes an annular skirt associated coaxially with each opening about which a mouth of a bag may be secured such as by a resilient strip or band or alternative fixing means.

Where the framework is surrounded by a bag, the bag is held in a generally open attitude and therefore prevented from being damaged as the container is moved in and out of the framework. When the bag is located internally of the framework, anchoring means are suitably provided to anchor the base of the bag to the framework or to other fixed mounting point in the chamber. The framework suitably includes members upon which the container to be cooled seats directly or indirectly.

The apparatus may additionally include an open topped closed base receptacle which may be partially submerged within the cooling or chilling liquid. The receptacle is thus subject to the cooling or chilling effect of the liquid within the chamber. The receptacle may act as a holder for ice or for any other products such as foodstuffs which are required to be chilled or cooled.

Preferably the cooling or chilling liquid is maintained at a low temperature by means of a refrigeration unit which includes, within the chamber, cooling coils, the coils being in contact with the liquid so that the liquid is subject to the direct cooling effect of the coils. The coils are suitably located adjacent to the walls of the chamber. Preferably, circulating means suitably in the form of a circulating pump are provided for circulating the cooling or chilling liquid within the chamber.

The apparatus may include a timing and indicating arrangement which provides to the user a visual and/or aural indication of when containers may be removed from the apparatus.

In order to prevent excessive heating of liquid in the chamber, an insulating material is preferably disposed about the chamber so that the liquid therein is substantially insulated from external temperatures.

The cooling liquid preferably comprises a glycol solution, preferably a propylene glycol solution. Suitably the solution comprises water and food quality propylene glycol.

Timing means may be provided to indicate to a user the time that the container is left within the chilling liquid. Such timing means may be associated with a visual and/or audible alarm.

BRIEF DESCRIPTION OF THE DRAWINGS

Reference will now be made to the accompanying drawings which illustrate a preferred embodiment of the invention and wherein.

DETAILED DESCRIPTION OF THE PREFERRED EMBODIMENT

Figure 2:
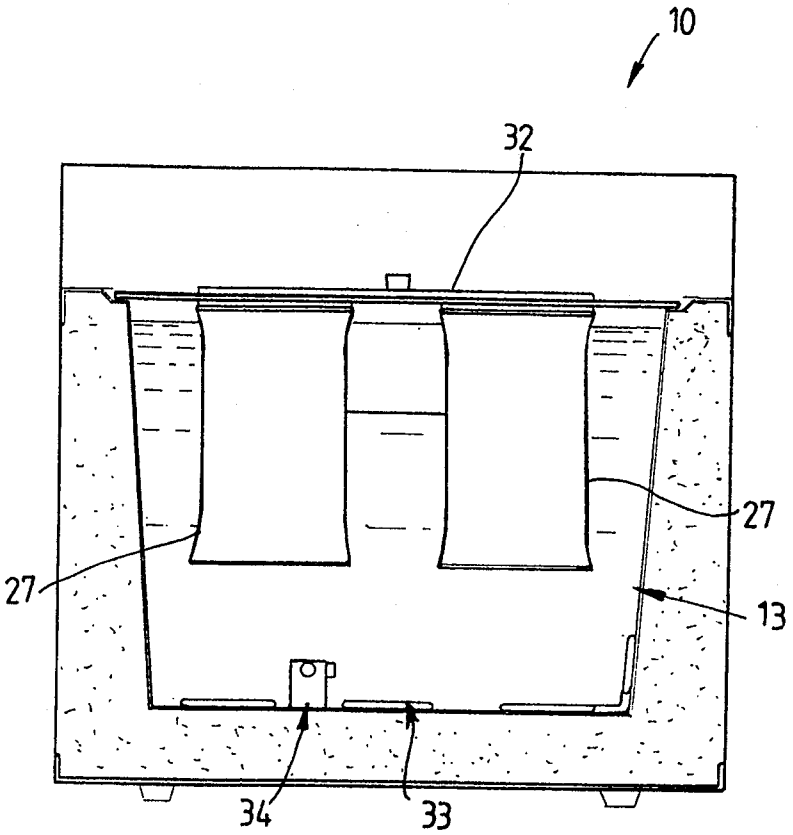
FIG. 2 is a sectional end-elevational view of the chamber of the apparatus of FIG. 1 with the bottle removed.
Figure 1:
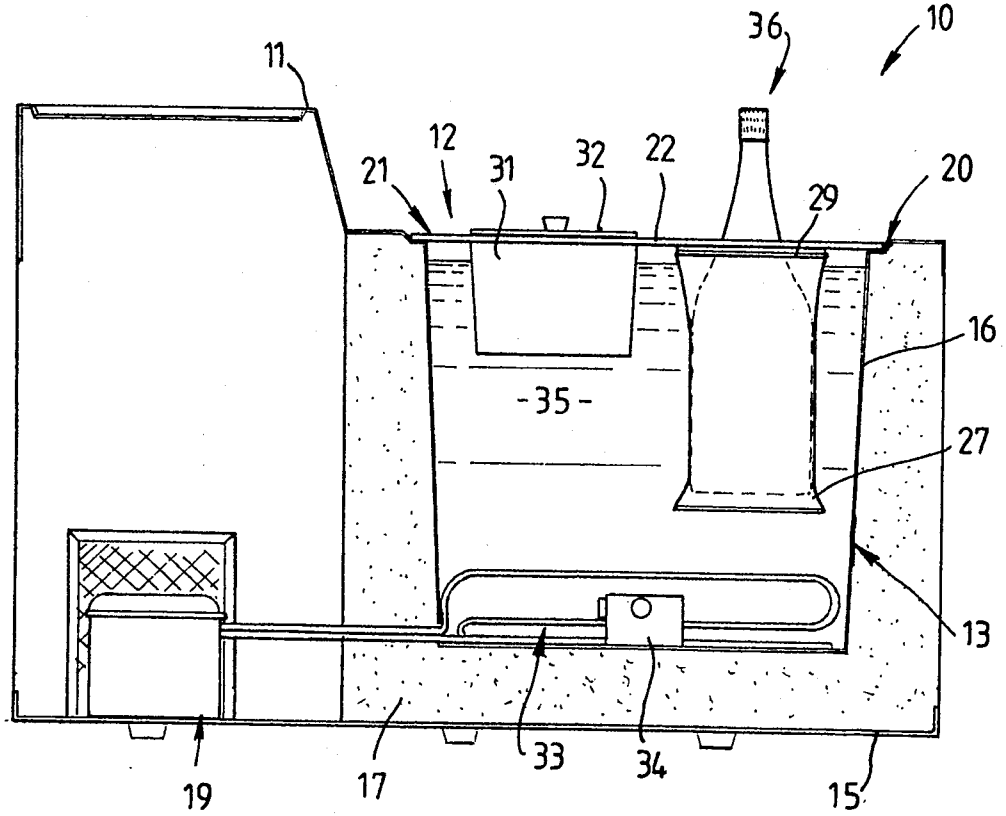
FIG. 1 is a sectional side-elevational view of the apparatus according to one form of the present invention showing a bottle being cooled or chilled.

Referring to the drawings and firstly to FIGS. 1 and 2 there is illustrated cooling or chilling apparatus 10 according to one form or the present invention including an external casing 11 surrounding an inner chamber assembly 12 which defines a hollow chamber 13 adapted to contain a liquid. Preferably, the chamber 13 and portion of the external casing 11 are formed of glass reinforced plastics (GRP) supported on an external metal base 15. The chamber 13 includes outwardly flared side walls 16 and is surrounded by an insulating material 17 such as a plastics foam which fills the space between the side walls 16 and at least portion of the casing 11 and base 15. The casing 11 also defines adjacent the chamber 13 a space 18 for a motor and compressor of a refrigeration unit 19.

Figure 3:
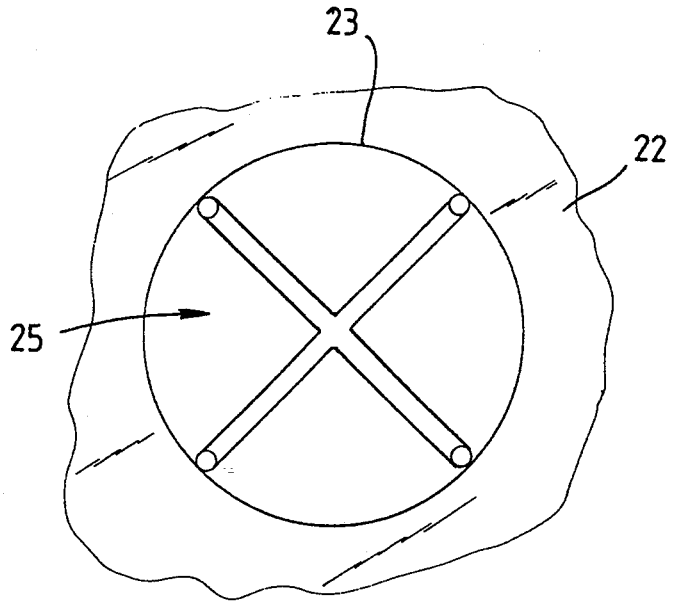
FIG. 3 is a plan view of one form or container supporting means for the apparatus of FIGS. 1 and 2.
Figure 4:
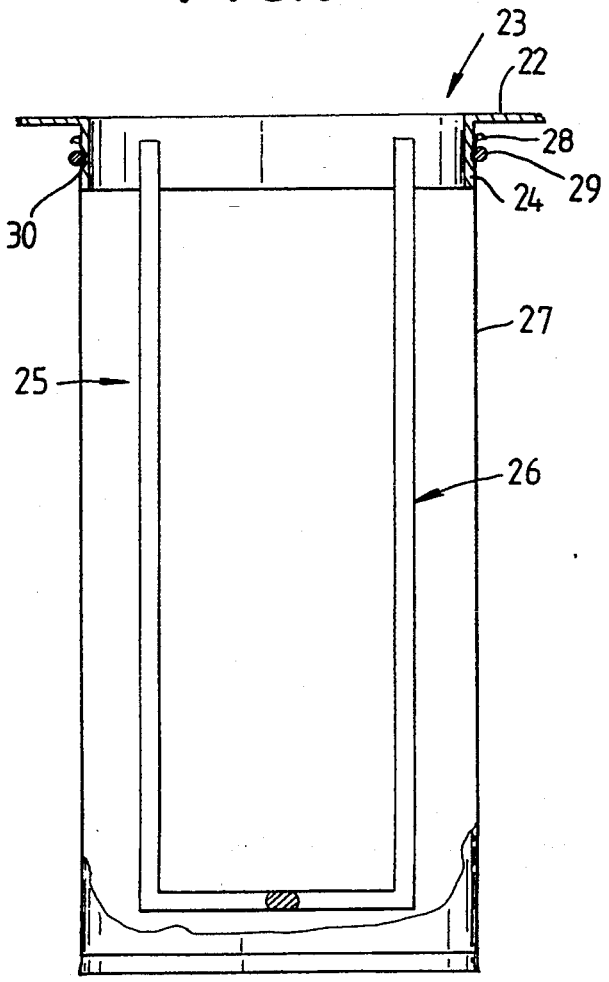
FIG. 4 is a part sectional elevational view of the containing supporting means of FIG. 3.

Defined in the chamber walls 16 is an upper ledge 20 about the upper periphery of the chamber 13 which is adapted to receive a top cover assembly 21 which defines a support for bottles or other containers to be chilled. The cover assembly 21 includes as more clearly shown in FIGS. 3 and 4, a top plate 22 provided with a number of openings 23, in this instance two, into which respective bottles to be chilled may be inserted. The underside of the plate 22 about each opening 23 is provided with a downwardly extending annular skirt 24 coaxial with the opening 23. Also extending to the underside of the plate 22 is a framework 25 comprising U-or J-shaped frame members 26 arranged at right angles to each other. The members 26 are arranged within the skirt 24 and preferably are secured thereto for example by welding. Surrounding the framework 25 is a bag 27 of plastics material which has its upper end or mouth 28 located about the skirt 24. A rubber band 29 or other securing means is provided to hold the mouth 28 of the bag 27 to the skirt 24. If desired the skirt 24 may incorporate an annular groove 30 or rib to receive or locate the band 29 to more securely hold the bag 27 in position.

In this embodiment, the top cover assembly 21 incorporates a hollow receptacle 31 which also extends to the underside of the top plate 22, the receptacle 31 being open at its top side but extending below the top plate 22 to an extent that it is submerged at least partially in the cooling liquid in use. A removable cover 32 is provide for the receptacle 31.

Refrigeration coils 33 are provided in the lower portion of the chamber 13 adjacent to the walls an/or base thereof and extending out of the chamber 13 to communicate with the refrigeration unit 19. A circulation pump 34 is also preferably mounted in the chamber 13 to circulate the cooling or chilling liquid within the chamber 13.

In use, the chamber 13 is filled with a chilling liquid 35 up to the level indicated so that the bags 27 and receptacle 31 are substantially immersed. The pressure of the liquid 35 will tend to collapse the bags 27 however the bags 27 will be supported by the framework 25 against full collapse. The chilling liquid 35 preferably comprises a low freezing point liquid and most preferably a solution containing food quality glycol. The solution is preferably a solution of propylene glycol and water of 50% concentration. The refrigeration unit 19 is operated so that through heat exchange between the coil 33 and liquid 35, the liquid 35 is rapidly cooled until a temperature below freezing is achieved. Preferably the temperature is in the range of −20 to −28 degrees Centigrade. A bottle 36 to be chilled or cooled is simply placed into one of the openings 23 to seat upon the cross arms of the frame members 26 and be supported in an upstanding attitude as shown in FIG. 1. The pressure of liquid upon the bag 27 will force the bag 27 into contact with the external walls of the bottle 36 as shown in FIG. 1 so that the contents thereof are rapidly chilled through heat exchange. There is no direct contact however between the chilling liquid 35 and the bottle 36 so that the bottle remains dry. After a predetermined time the bottle 36 may be removed and is available for immediate use having been cooled to the desired temperature. The chilling liquid 35 also chills the container 31 which may be used for storage of ice or for maintaining other products in a cool or chilled state.

It will be apparent in the arrangement described above that many different types of containers may be supported and cooled including cans. It will be further apparent that the retrieval of cans will not subject the users hands to the direct chilling effect of the liquid.

Figure 5:
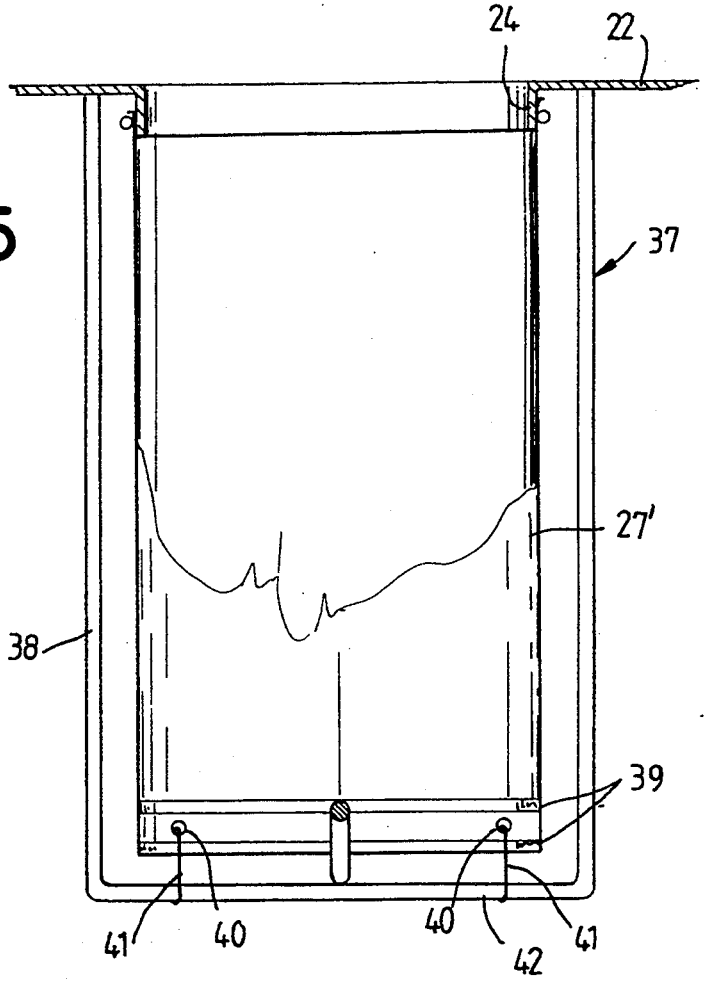
FIG. 5 is a part sectional elevational view of an alternative container supporting means for use in the apparatus of the invention.
Figure 6:
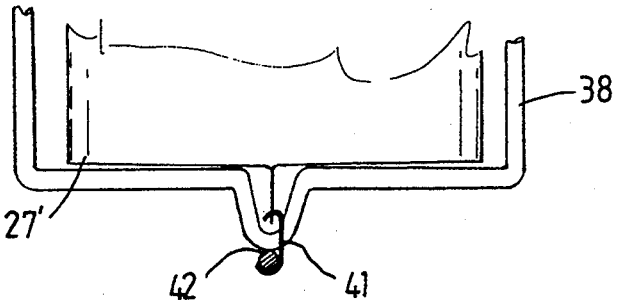
FIG. 6 is a view of the base region of the supporting means of FIG. 5.

In the arrangement illustrated the bag 27 is located externally of the frame assembly 25. In an alternative configuration shown in FIGS. 5 and 6 however, the bag 27′ may be supported within a container supporting frame 37 which may be of similar form to that used in the embodiment of FIGS. 3 and 4. For this purpose, the frame members 38 of the frame 37 are located radially outwardly of the skirt 24 which still supports the upper end or mouth of the bag 27′ in the manner described above. In this case however, the bag 27′ is provided with a double seam 39 in its base between which are provided apertures 40 for receiving clips 41 which secure the base of the bag 27′ to a cross arm or arms 42 of a frame member 38. A container to be chilled is still supported on the frame members 38 indirectly however the bag 27′ remains anchored at its base so that damage thereto is prevented when a container is being withdrawn.

Figure 8:
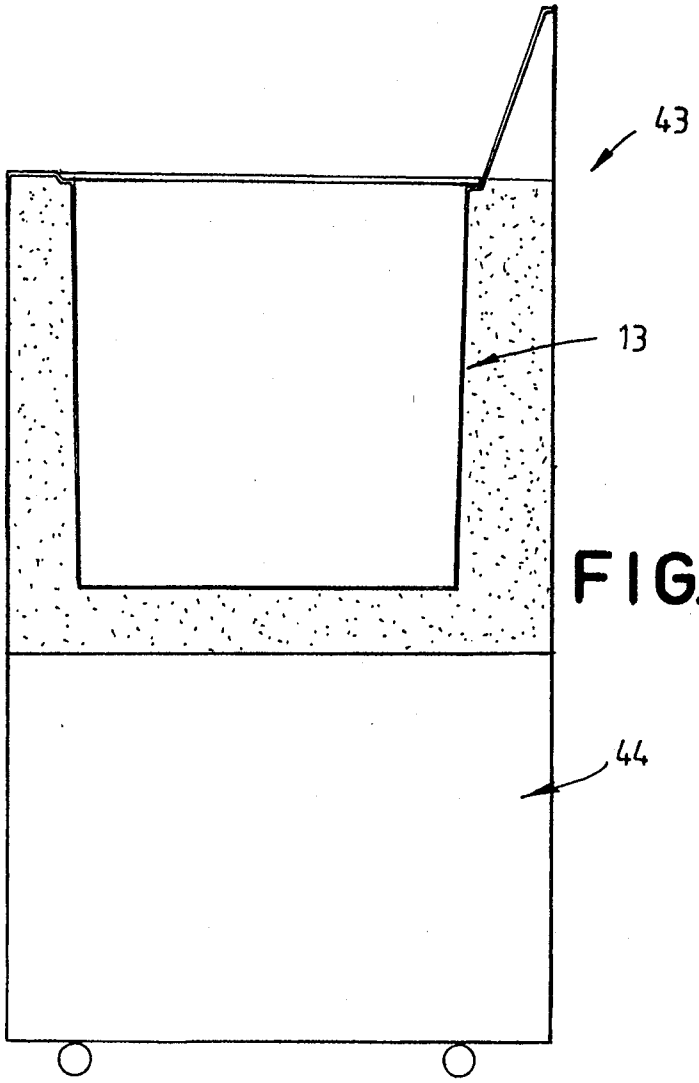
FIGS. 7 and 8 are sectional side and end elevational views of an alternative form of apparatus according to the present invention.
Figure 7:
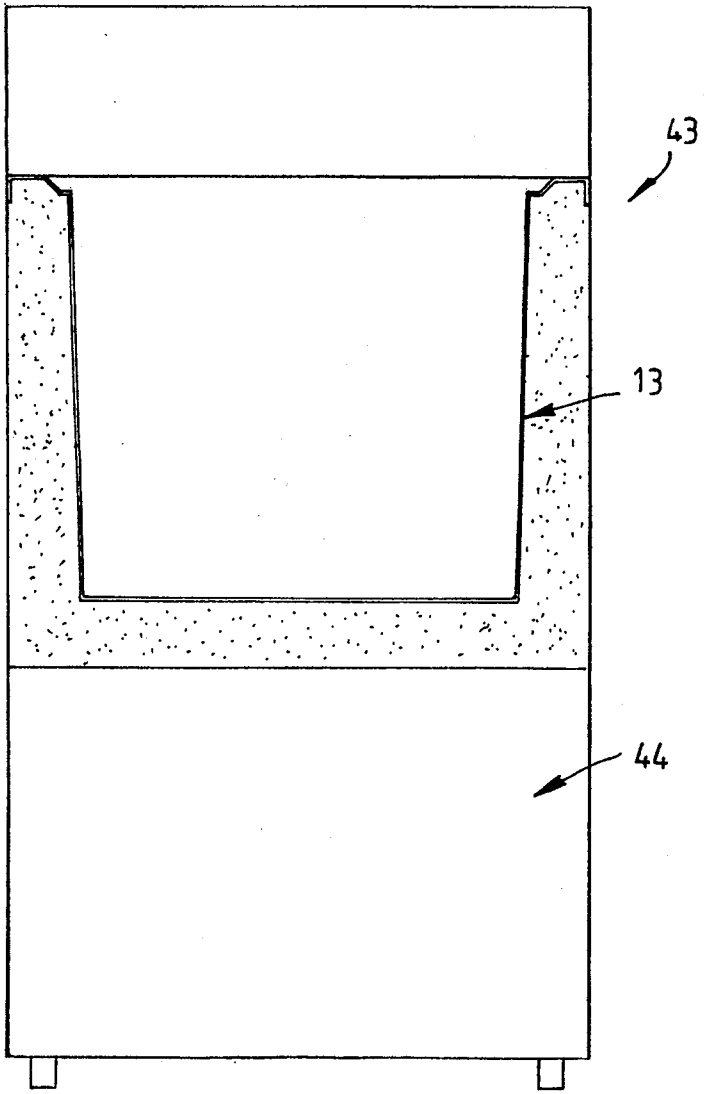

It will be appreciated that the configuration of the apparatus 10 may be substantially varied from the arrangement illustrated and described. An alternative floor standing model 43 is shown in FIGS. 7 and 8 wherein the refrigeration unit 19 is located in the base 44 of the apparatus beneath the chilling chamber 13. The container supporting means for this model 43 may be as described above with reference to FIGS. 1 and 2.

The arrangement for supporting the containers 36 may be in other forms than that described. For example, the framework 25 may be replaced by a cage of mesh or similar open material. Additionally, the bags 27 and 27′ may be of many different shapes and materials and comprise interconnected or moulded membranes or panels which will prevent liquid contact between the chilling liquid and bottle or other container to be cooled. As stated above, the bag 27 or membrane may be located within the framework 25 with the base secured thereto or held down in any other manner. The preferred material for the bags 27 and 27′ is polythene of 50 to 100 microns thickness however other liquid impervious plastics may be used for the bags.

In some circumstances, the framework may be eliminated and the bag or membrane extended to and secured to a base member upon which the container to be chilled may seat. Alternatively, the base of the bag or membrane may be closed and the bag or membrane either left suspended from the top cover or anchored to the base of the chamber 13. The bag or membrane in this instance comprises the means which supports the container to be chilled.

Of course the upper end of the bag or membrane may be secured to the top cover 22 about an opening 23 in any suitable fashion for example by means of fasteners, clamps or adhesives.

The upper portion of each apparatus 10 and 43 may be provided with an indicator light or lights and a timing switch which when actuated say when a container is inserted into the apparatus will provide an indication to the user by illumination of the indicator light or lights when the container is ready to be removed from the apparatus being sufficiently chilled. An audible alarm may also be provided for this purpose.

Whilst the above has been given by way of illustrative embodiment of the invention, all such modifications and variations thereto as would be apparent to persons skilled in the art are deemed to fall within the broad scope and ambit of the invention as defined in the appended claims.

We claim:

1. Apparatus for cooling or chilling beverage containers and the contents thereof, said apparatus comprising a chamber, cooling or chilling liquid within said chamber, a bag extending into said chamber, said bag having an upper open end and a closed lower end, said bag being formed of a liquid impervious flexible membrane means, container supporting means extending into said bag from the upper end thereof and defining a fixed support base within said bag on which a said container may be supported, said flexible membrane means being adapted to be urged by said liquid into direct contact with a said container supported on said base whereby said container is subject to the cooling or chilling effect of said liquid but prevented from direct contact with said cooling or chilling liquid, said supporting means restraining said bag within said chamber when a said container is withdrawn therefrom.

2. Apparatus according to claim 1 wherein said supporting means includes a framework for supporting said containers so that a major portion thereof is arranged below the level of cooling or chilling liquid in said chamber.

3. Apparatus according to claim 2 wherein said bag has its upper end or mouth supported above the level of liquid in said chamber.

4. Apparatus according to claim 3 wherein said chamber has a top cover provided with one or more openings associated with respective said bags and container supporting means for receipt of respective said containers to be chilled.

5. Apparatus according to claim 4 wherein said top cover includes an annular skirt associated with the or each opening about which the upper open end of a said bag may be secured.

6. Apparatus according to claim 5 wherein said bag upper end is secured about said skirt by means of a resilient member.

7. Apparatus according to claim 5 wherein said framework includes frame members upon which said containers may seat, said framework being secured to said annular skirt and extending into said bag.

8. Apparatus according to claim 1 and including an open topped receptacle which is partially submerged within the cooling or chilling liquid.

9. Apparatus according to claim 1 and including refrigeration coils within said chamber for maintaining said cooling or chilling liquid at a low temperature.

10. Apparatus according to claim 1 and including liquid circulating means within said chamber for circulating said cooling or chilling liquid within the chamber.

11. Apparatus according to claim 1 wherein said chamber has side walls and including an insulating material disposed externally of the chamber walls so that the liquid is substantially insulated from external temperatures.

12. Apparatus for cooling or chilling containers and the contents thereof, said apparatus comprising a chamber containing a cooling or chilling liquid, a top wall over the top of said chamber, an opening in said top wall, a skirt surrounding said opening and extending downwardly from said top wall, a bag having an open upper end aligned with said opening, said open upper end of said bag being located about the outer side of said skirt and being secured thereto, said bag extending into said chamber and having a closed lower end, said bag being formed of a thin flexible liquid impervious material, a fixed support frame secured to the inner side of said skirt and extending into said bag, said support frame defining adjacent said lower end of said bag a fixed support base on which a said container may be supported, the wall of said bag being adapted to be urged by said liquid into direct contact with a said container, whereby said container is subject to the cooling or chilling effect of said liquid but prevented from direct contact with said cooling or chilling liquid, said support frame restraining said bag within said chamber when a said container is withdrawn therefrom.

13. Apparatus according to claim 12 wherein said support frame includes at least one upright elongated frame member extending into said bag, said support base being disposed at the lower end of said frame member.

14. Apparatus according to claim 13 wherein said support frame includes a plurality of spaced apart said frame members.

15. Apparatus for cooling or chilling containers, said apparatus including a chamber for containing a cooling or chilling liquid, a top wall over the top of said chamber, an opening in said top wall, a bag formed of thin flexible impervious material, said bag having an open upper end secured about said opening and a closed lower end within said chamber, a fixed support frame for containers, said support frame including at least one pair of spaced apart thin elongated upright frame members secured to said top wall and extending into said bag, said frame members supporting at their lower end a fixed support base for containers, said bag being adapted to be urged by said liquid into direct contact with a container supported on said support base whereby said container is subject to the cooling or chilling effect of said liquid but prevented from direct contact therewith, and said support frame restraining said bag within said container.

16. Apparatus according to claim 15 wherein said support base includes a base frame on which said containers may be supported, said base frame being disposed adjacent said lower end of said bag and supported by said upright frame members.

17. Apparatus according to claim 16 wherein said base frame is defined by inwardly directed extensions of said upright frame members.

18. Apparatus according to claim 15 wherein said top wall includes a downwardly depending skirt surrounding said opening, said open upper end of said bag being secured to the outside of said skirt and said frame members being secured at their upper ends to the inside of said skirt.

* * * * *